US005342588A

United States Patent [19]

Humpolik

[11] Patent Number: 5,342,588

[45] Date of Patent: Aug. 30, 1994

[54] METER SUPPORT MATRIX FOR A CATALYTIC REACTOR

[75] Inventor: Bohumil Humpolik, Ludwigsburg, Fed. Rep. of Germany

[73] Assignee: Emitec Gesellschaft fuer Emissionstechnologie mbH, Lohmar, Fed. Rep. of Germany

[21] Appl. No.: 4,185

[22] Filed: Jan. 13, 1993

Related U.S. Application Data

[63] Continuation of Ser. No. 699,939, May 14, 1991, abandoned.

[30] Foreign Application Priority Data

May 21, 1990 [DE] Fed. Rep. of Germany ..... 4016276

[51] Int. Cl.[5] ..... B01J 21/04; B01D 50/00

[52] U.S. Cl. ..... 422/311; 422/171; 422/177; 422/179; 422/180; 502/439; 502/527

[58] Field of Search ..... 422/177, 186, 171, 179, 422/180; 502/439, 527

[56] References Cited

U.S. PATENT DOCUMENTS

| | | | |
|---|---|---|---|
| 3,890,104 | 6/1975 | Porta et al. | 422/197 |
| 4,928,485 | 5/1990 | Whittenberger | 502/527 X |

FOREIGN PATENT DOCUMENTS

| | | | |
|---|---|---|---|
| 0245736 | 11/1987 | European Pat. Off. | 502/439 |
| G8908671.6 | 3/1990 | Fed. Rep. of Germany . | |
| 4016276 | 6/1991 | Fed. Rep. of Germany . | |
| 9003220 | 4/1990 | World Int. Prop. O. . | |

*Primary Examiner*—Robert J. Warden
*Assistant Examiner*—Christopher Y. Kim
*Attorney, Agent, or Firm*—Herbert L. Lerner; Laurence A. Greenberg

[57] ABSTRACT

A metal support matrix for a catalytic reactor for exhaust emission control, in particular for internal combustion engines, which includes a plurality of stacks of sheet metal layers, each stack having a central end and a free end, and a jacket which encompasses the stacks. The central ends of the stacks contact each other and the free ends are mutually twisted around a point of symmetry so that the free ends contact the inner surface of the jacket. Prior to twisting, the stacks are in the shape of a rectangle, trapezoid or parallelogram.

27 Claims, 5 Drawing Sheets

Fig. 1a
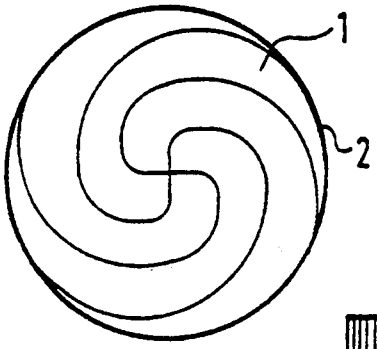
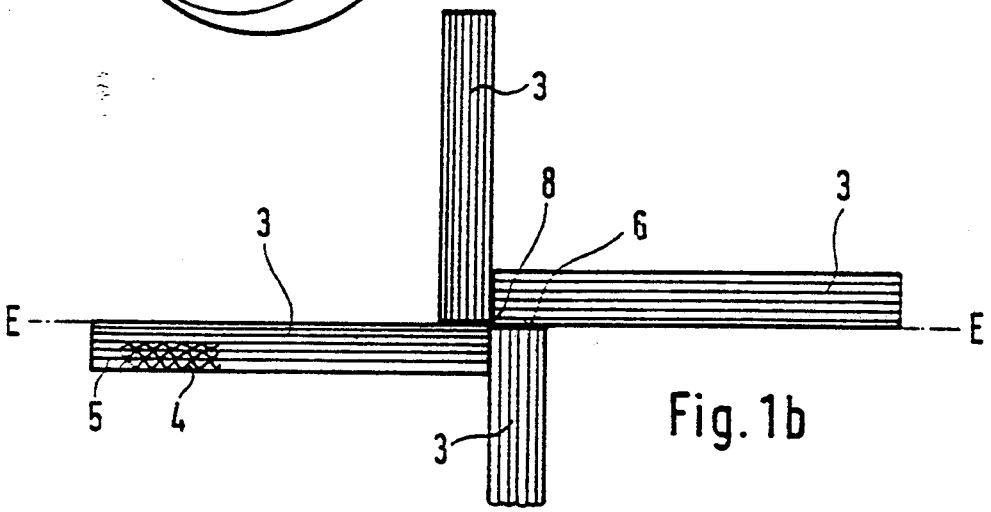
Fig. 1b
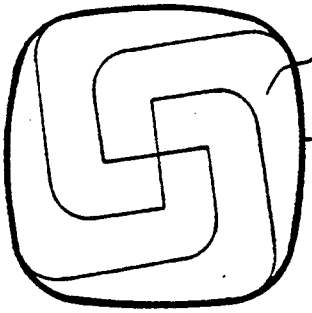
Fig. 2a
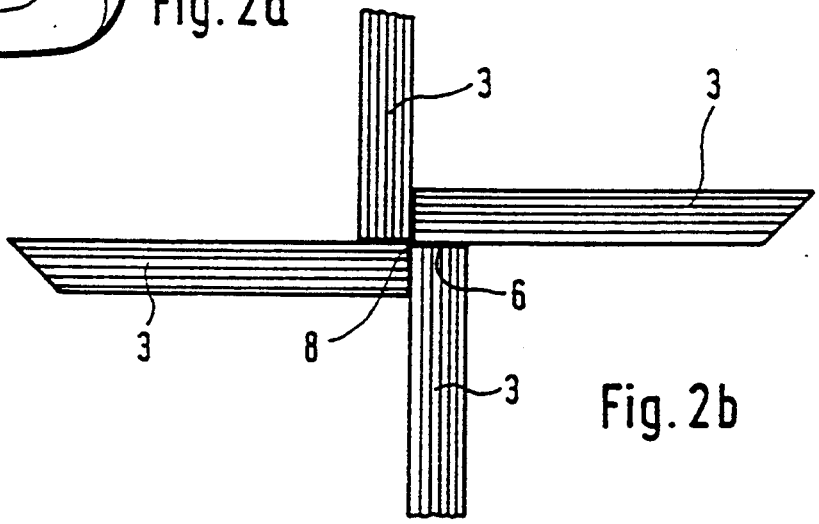
Fig. 2b

Fig. 3a
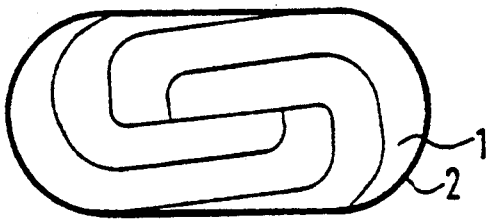
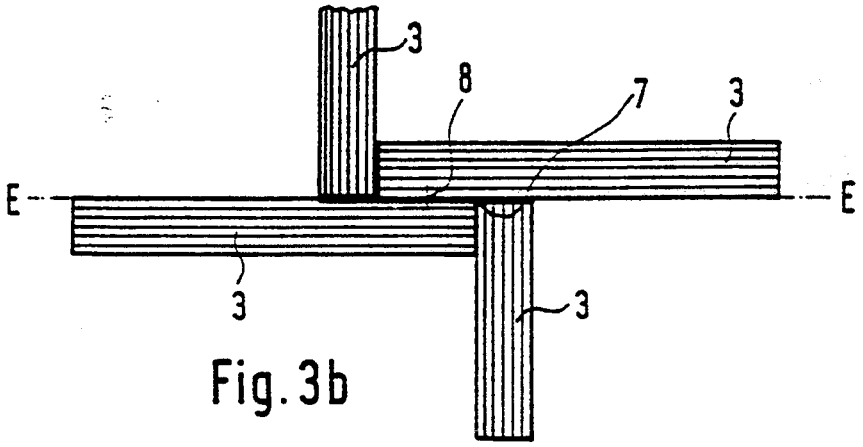
Fig. 3b
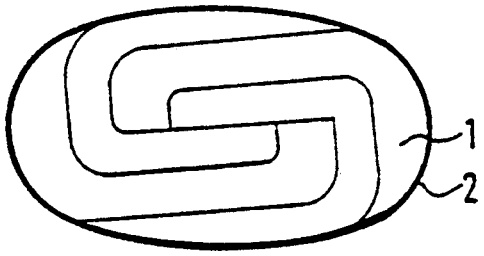
Fig. 4a
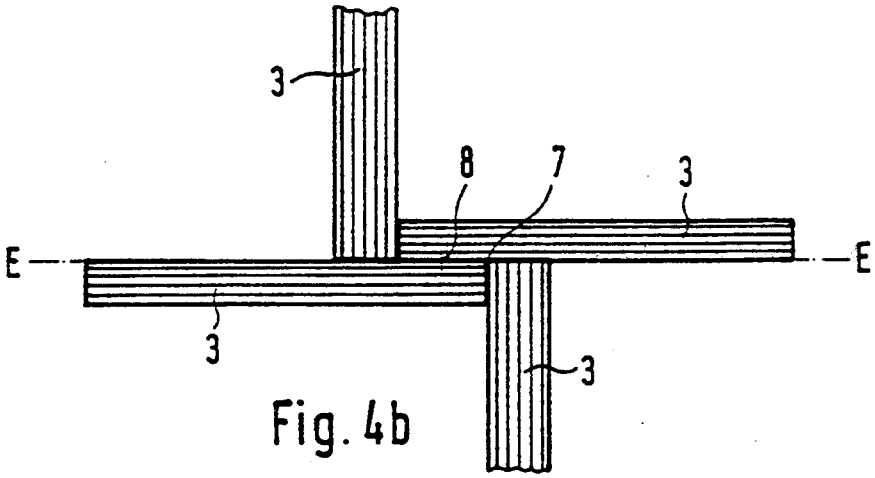
Fig. 4b

METER SUPPORT MATRIX FOR A CATALYTIC REACTOR

This application is a continuation of application Ser. No. 07/699,939, filed May 14, 1991, now abandoned.

BACKGROUND OF THE INVENTION

The present invention relates to a metal support matrix for a catalytic reactor for exhaust emission control, in particular for catalytic converters for internal combustion engines.

It is known from EP-A1 245 737 to produce a metal support matrix for a catalytic reactor by layering a plurality of smooth and corrugated metal strips alternately to form one stack, and twisting the ends of this stack around two fixed points. This metal support matrix is inserted into a tubular jacket and connected thereto using techniques wellknown in the art.

The foregoing method has the disadvantage that special or custom-designed forms have to be produced by inserting loose filling pieces. Moreover, it is disadvantageous that twisting thicker sheet metal stacks, which are required to produce larger catalyst diameters, requires exceptionally high forces.

It is also known from DE-U1 89 08 671 to produce metal support matrices from more than two stacks, the individual stacks being folded about a bend line and subsequently twisted jointly. A disadvantage of this procedure is that each individual stack must be folded in a separate work step. Moreover, with this type of production of a metal support matrix, regions unoccupied by the honeycomb remain in the interior of the support matrix, in particular in the center of the support matrix.

SUMMARY OF THE INVENTION

It is therefore an object of the present invention to provide a metal support matrix for a catalytic reactor for exhaust emission control that has a homogeneous honeycomb structure, is easy to produce from a multiplicity of sheet metal layers, and wherein, as far as possible, each sheet metal layer comes into contact with the covering jacket.

In accomplishing the foregoing objects there is provided according to the present invention a metal support matrix for a catalytic reactor for exhaust emission control, comprising at least two distinct stacks consisting of a plurality of sheet metal strips, each of said stacks having a central end and a free end, and a jacket encompassing said stacks, wherein said stacks are arranged in a twisting pattern so that said central ends contact each other and said free ends securely contact said jacket.

There also is provided a method for producing the above-described metal support matrix, comprising the steps of (a) providing at least two stacks consisting of a plurality of sheet metal strips, each of said stacks having a central end and a free end; (b) positioning said stacks so that said central ends are in contact; (c) twisting said free ends around a point of symmetry while contact is maintained between said central ends; (d) continuing step (c) until said stacks are arranged into a predetermined shape; (e) inserting the resulting stack arrangement into a jacket; and (f) joining together the sheet metal layers and the jacket to form the metal support matrix.

Further objects, features and advantages of the present invention will become apparent from the detailed description of preferred embodiments that follows.

BRIEF DESCRIPTION OF THE DRAWINGS

Exemplary embodiments of the present invention are described below in detail with reference to the drawing, wherein:

FIG. 1*a* is a cross-sectional representation of a first embodiment according to the present invention;

FIG. 1*b* is a side view of a pre-twisting arrangement of the stacks associated with the first embodiment;

FIG. 2*a* is a cross-sectional representation of a second embodiment according to the present invention;

FIG. 2*b* is a side view of a pre-twisting arrangement of the stacks associated with the second embodiment;

FIG. 3*a* is a cross-sectional representation of a third embodiment according to the present invention;

FIG. 3*b* is a side view of a pre-twisting arrangement of the stacks associated with the third embodiment;

FIG. 4*a* is a cross-sectional representation of a fourth embodiment according to the present invention;

FIG. 4*b* is a side view of a pre-twisting arrangement of the stacks associated with the fourth embodiment;

DETAILED DESCRIPTION OF THE PREFERRED EMBODIMENTS

Figure 5A:
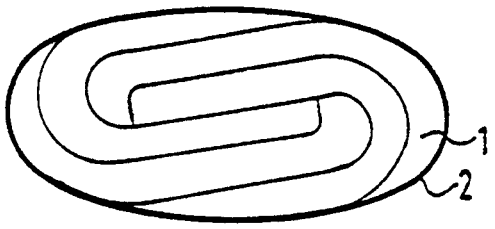
FIG. 5*a* is a cross-sectional representation of a fifth embodiment according to the present invention.

The present invention permits easy production of a metal support matrix consisting of a multiplicity of sheet metal layers. In particular, it is easy to adapt to different forms of the jacket which surrounds the metal support matrix. Numerous different forms of the metal support matrix can be generated by varying the length and/or the thickness of the individual stacks. Thus, the production of special forms, for example of elliptical support matrices, does not require insertion of filling pieces, as a result of which a substantial reduction in the production costs is achieved.

The embodiment according to the present invention of a metal support matrix consisting of four stacks is also particularly advantageous, since this embodiment produces a very uniform distribution of the lines of contact of the sheet metal layers with the jacket on the inner jacket surface.

The present invention also provides an advantageous embodiment of an elliptical or ellipse-like form of a catalytic reactor. In the case of elliptical or ellipse-like forms of a catalytic reactor, the uniform distribution of the lines of contact on the inner jacket surface can be obtained advantageously when a round metal support matrix having a relatively large cavity in the interior is pressed into the desired elliptical or ellipse-like form.

The shape of the individual stacks of sheet metal layers from which the metal support matrix is produced always has at least two parallel edges as seen from the side view. The free ends of the stacks can be beveled so that the stacks are in geometrical forms such as a trapezoid.

FIG. 1*a* shows a first embodiment according to the present invention, wherein there is represented a circular form of a catalytic reactor, and in FIG. 1*b* the pre-twisting or non-deformed arrangement of the stacks 3 associated with the circular form. The stacks have a generally rectangular form consisting of a free end 10, a central end 11 and two substantially parallel sides 12 and 13, and in the particular embodiments shown in the drawing, consist of corrugated 4 and smooth 5 sheet metal layers layered alternately one above another. The stacks also can consist of corrugated sheet metal layers alone or corrugated sheet metal layers mixed with smooth sheet layers in any particular order. The stacks can be formed by either stacking or folding the sheet metal layers.

In the embodiment depicted in FIGS. 1*a* and 1*b*, the stacks should be substantially identical in their dimensions. Prior to twisting, the stacks 3 are arranged in such a way that, as seen from the side view of the stack arrangement, the lines of contact between the individual stacks 3 form a graphic representation of a cross 6, preferably a rectangular-shaped or Greek cross, which is illustrated in FIG. 1*b* by thicker lines. The free ends 10 of the stacks 3 are twisted clockwise by known methods around a stationary point of symmetry 8, which in this embodiment is the intersect point of the cross 6, while contact is maintained between the central ends or portions 11 of the stacks 3. As a result of this mutual twisting, the sides 12 and 13 of each stack contact the respective side 12 or 13 of both adjacent stacks.

The metal support matrix 1 thus produced subsequently is inserted into a jacket 2. In the next production step, the sheet-metal layers 4, 5 of the metal support matrix 1 and the jacket 2 are connected together using a method known in joint-forming technology, preferably by soldering.

In a second embodiment, a square form of a catalytic reactor (with rounded corners) is shown in FIGS. 2*a* and 2*b*. Similar to the circular embodiment of FIG. 1, the arrangement of the stacks 3 is cross-shaped. In the embodiment of FIG. 2, however, each of the individual stacks 3 are not rectangular as seen from the side view, but come to a point, i.e., are beveled, at the free end 10 away from the point of symmetry 8. That is, the individual stacks 3 are designed to be in the form of a trapezoid. The production process for the square embodiment of FIG. 2 follows the same procedure as described in connection with the circular embodiment of FIG. 1.

A third embodiment depicted in FIG. 3*a* is an elongated form of a catalytic reactor. FIG. 3*b* illustrates the pre-twisting arrangement of the stacks 3 associated with the third embodiment. The arrangement of the individual stacks 3 is generally cross-shaped. The stacks 3, however, are displaced relative to one another above and below a displacement plane E—E, which is perpendicular to the plane of the drawing, so that a displaced cross 7 is produced, which is represented in the drawing by thicker lines. The length of the stacks 3 perpendicular to the displacement plane E—E determines the width of the catalytic reactor. As already described in connection with the embodiment of FIG. 1, the free ends 10 of the stacks 3 are twisted clockwise around the point of symmetry 8, which is arranged in the displacement plane E—E and centrally positioned between the two displaced stacks 3 which are perpendicular to the displacement plane E—E. The further production steps take place as described in connection with the embodiment of FIG. 1.

Figure 5B:
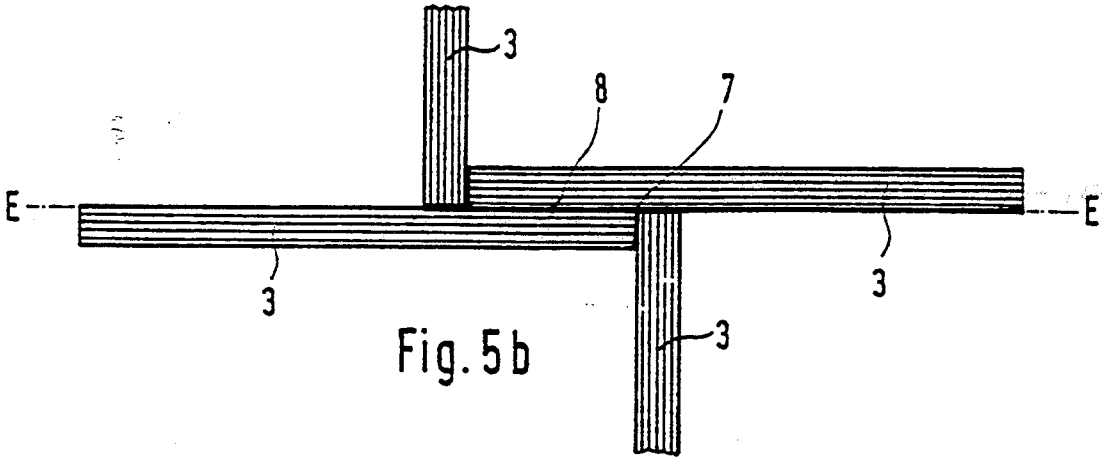
FIG. 5*b* is a side view of a pre-twisting arrangement of the stacks associated with the fifth embodiment.

A further embodiment is represented in FIGS. 4*a* and 5*a* wherein the catalytic reactor is in elliptical form. FIGS. 4*b* and 5*b* show the pre-twisting arrangements of the stacks 3 associated with the elliptical-shaped embodiments of FIGS. 4*a* and 5*a*. The arrangement of the stacks 3 is similar to the arrangement shown in FIG. 3*b* except that the stacks 3 shown here are varied in thickness and length. This produces further different forms for the catalytic reactor. The production process proceeds as explained in the description relating to FIG. 1.

Figure 6A:
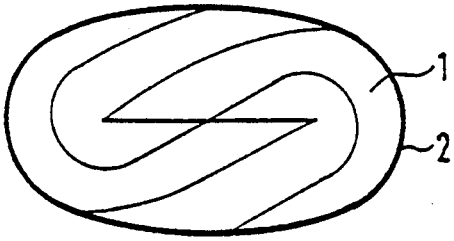
FIG. 6*a* is a cross-sectional representation of a sixth embodiment according to the present invention.
Figure 6B:
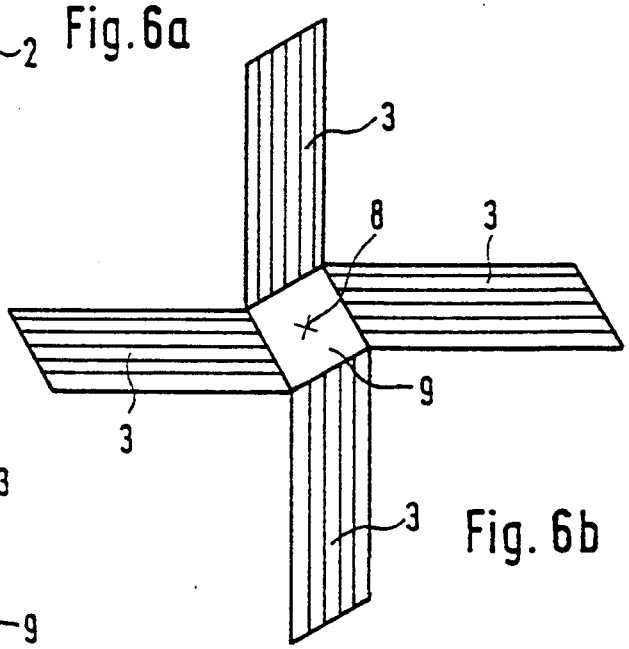
FIG. 6*b* is a side view of a pre-twisting arrangement of the stacks associated with the sixth embodiment.
Figure 6C:
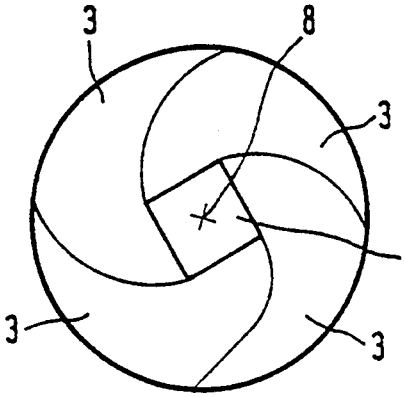
FIG. 6*c* is a side view of an arrangement of the stacks after twisting according to the sixth embodiment.

Represented in FIG. 6*a* is a further embodiment of an elliptical form of the catalytic reactor, in FIG. 6*b* the associated arrangement of the stacks 3 before twisting, and in FIG. 6*c* the associated arrangement of the stacks 3 after twisting. As seen from the side view, the stacks 3 have the general shape of a parallelogram. They are arranged in the shape of a cross about the point of symmetry 8 in such a way as to define a central rectangular cavity 9. The free ends 10 of the stacks 3 are twisted clockwise around the cavity 9 or the point of symmetry 8, which is positioned at the midpoint of the cavity 9. After twisting, a round form of the metal support matrix 1 is produced, which is represented in FIG. 6*c*. Starting from this round form, the metal support matrix 1 is pressed with the aid of suitable tools into the desired elliptical form, thereby closing the central cavity 9. The metal support matrix 1 is inserted into a jacket 2 and connected thereto using methods known in joint-forming technology.

Figure 7A:
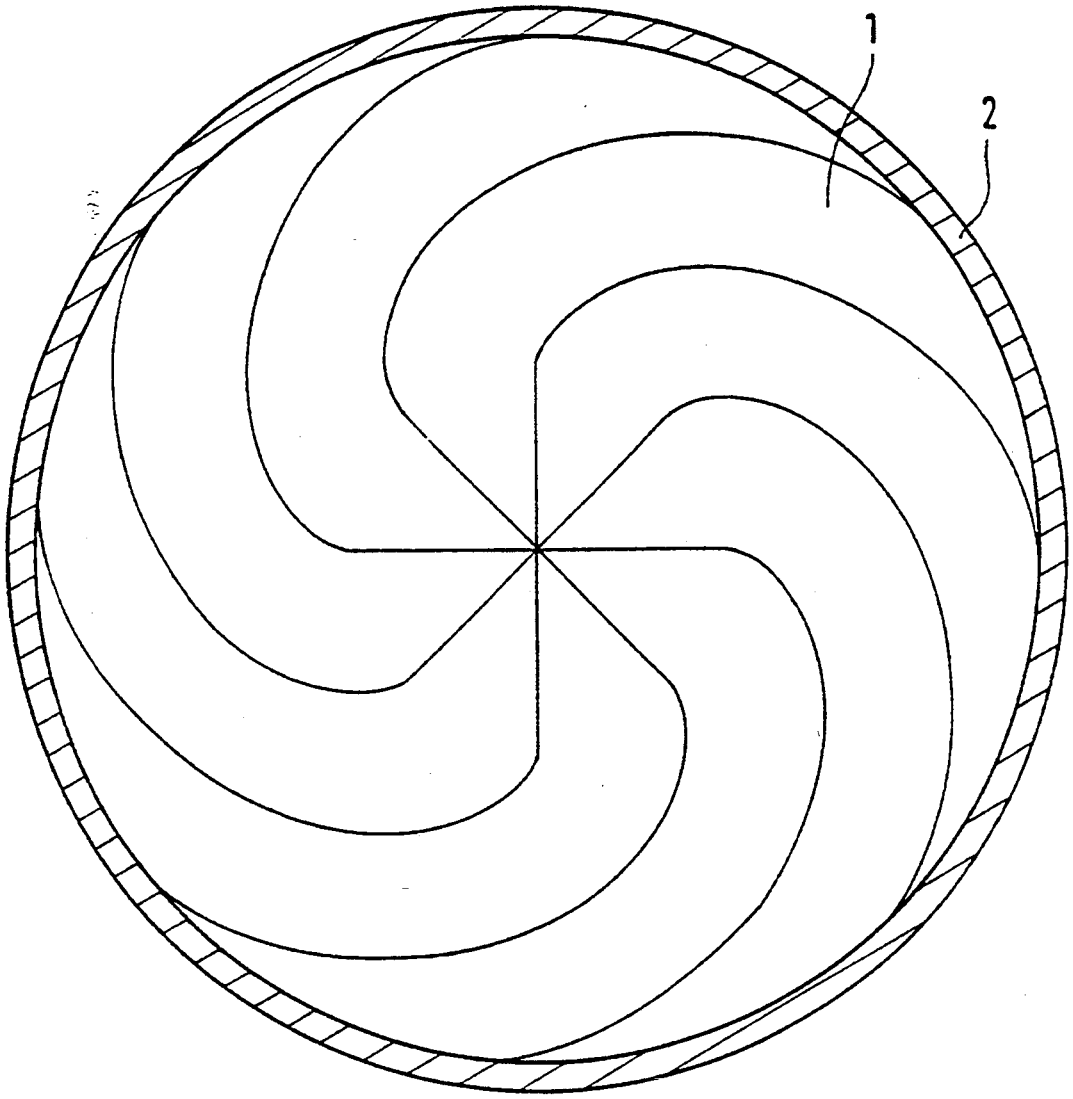
FIG. 7*a* is a cross-sectional representation of a seventh embodiment according to the present invention.
Figure 7B:
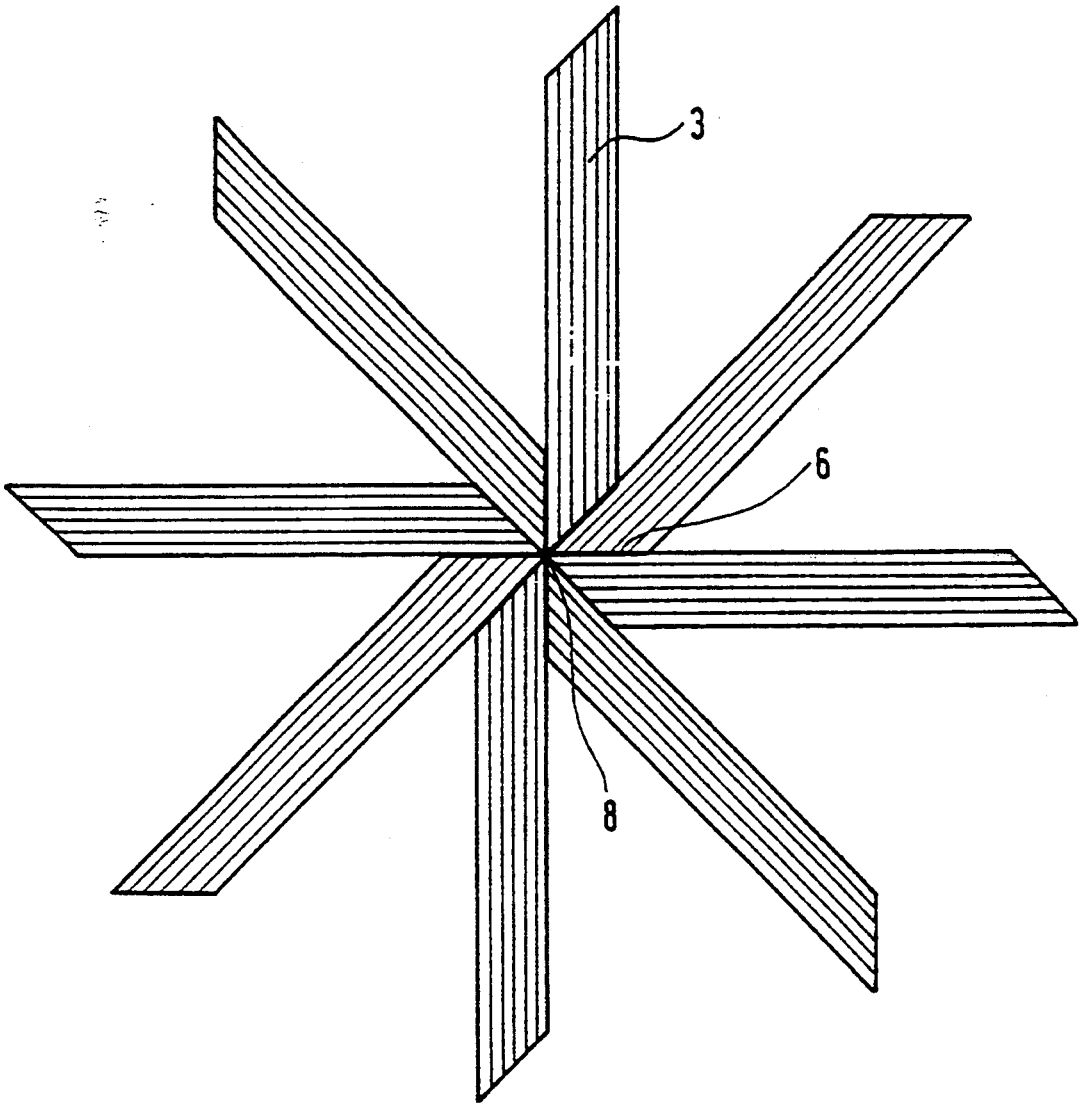
FIG. 7*b* is a side view of a pre-twisting arrangement of the stacks associated with the seventh embodiment.

According to a seventh embodiment of the present invention shown in FIG. 7*a* and 7*b*, eight stacks 3 are arranged radially around a point of symmetry 8 so that the stacks 3 form an acute angle with each other. Preferably, the stacks 3 have the general shape of a parallelogram as seen from the side view. The free ends 10 of the stacks 3 then are twisted in the same direction around the point of symmetry 8 as the central ends 11 are maintained in contact. After twisting, a circular form of the metal support matrix 1 is produced, which is represented in FIG. 7*a*.

As the few exemplary embodiments already show, a multiplicity of further variant forms are possible with the aid of the metal support matrix 1 according to the present invention.

What is claimed is:

1. A metal support matrix for a catalytic reactor for exhaust emission control, comprising:

at least two distinct stacks including a plurality of layers of sheet metal strips, each of said stacks having substantially parallel sides a central end and an outer free end, said sheet metal strips of said layers having central free ends disposed at said central ends of said stacks, and a jacket encompassing said stacks, wherein said stacks are arranged in a twisting pattern and said central free ends of said sheet metal strips of one of said stacks transversely abut one of said sides of another of said stacks and said outer free ends of said stacks fixedly contact said jacket.

2. A metal support matrix according to claim 1, wherein said stacks further comprise a plurality of layers of corrugated metal strips.

3. A metal support matrix according to claim 1, wherein said stacks are formed from untwisted stacks in the shape of a rectangle, trapezoid or parallelogram as seen from a side view.

4. A metal support matrix according to claim 1, wherein at least one of said stacks has at least a thickness which is different than the thickness of the other stacks.

5. A metal support matrix according to claim 1, wherein at least one of said stacks has at least a length which is different than the length of the other stacks.

6. A metal support matrix according to claim 1, wherein said metal support matrix has a round cross-section and said four stacks are formed from untwisted stacks wherein contact lines between central ends of said untwisted stacks form the shape of a cross.

7. A metal support matrix according to claim 1, wherein said metal support matrix has a square cross section and said four stacks are formed from untwisted stacks wherein contact lines between central ends of said untwisted stacks form the shape of a cross.

8. A metal support matrix according to claim 1, wherein said metal support matrix has an elliptical cross-section and said four stacks are formed from untwisted stacks wherein contact lines between central ends of said untwisted stacks form the shape of a cross displaced in a displacement plane.

9. A metal support matrix according to claim 1, wherein said metal support matrix has an elliptical cross-section and said four stacks are formed from untwisted stacks each having the shape of a parallelogram and arranged in the form of a cross such that central ends of said untwisted stacks define a central rectangular cavity, said cavity being closed in said twisting pattern.

10. A metal support matrix according to claim 1, wherein said twisting pattern is symmetrical about a point in a central region of said jacket and is approximately symmetrical about said point in edge regions of said jacket.

11. A metal support matrix according to claim 1, wherein said sheet metal strips are joined to each other.

12. A metal support matrix according to claim 1, wherein untwisted stacks are arranged radially around said point of symmetry such that said untwisted stacks form acute angles with each other.

13. A metal support matrix according to claim 1, wherein said stacks further comprise alternating layers of corrugated metal strips and smooth metal strips.

14. The metal support matrix according to claim 1, wherein said at least two stacks are four stacks twisted around a point of symmetry.

15. The metal support matrix according to claim 1, wherein said at least two stacks are more than four stacks twisted around a point of symmetry.

16. The metal support matrix according to claim 1, wherein said at least two stacks are eight stacks.

17. A method for producing a metal support matrix for a catalytic reactor for exhaust emission control comprising the steps of:

(a) providing at least two stacks comprising a plurality of layers of sheet metal strips, each of said stacks having sides, a central end with central free ends of sheet metal strips and an outer free end;

(b) positioning said stacks so that said central ends of one of said stacks are in transversely abutting contact with one of said sides of another of said stacks;

(c) twisting said outer free ends around a point of symmetry while contact is maintained between said central end of one of said stacks with said one side of the other of said stacks;

(d) continuing step (c) until said stacks are arranged into a predetermined shape;

(e) inserting the resulting stack arrangement into a jacket; and (f) joining together the sheet metal layers and the jacket to form a metal support matrix.

18. A method according to claim 17, wherein said stacks of step (a) are in the shape of a rectangle, trapezoid or parallelogram as seen from a side view.

19. A method according to claim 17, wherein step (a) comprises providing four of said stacks, step (b) comprises positioning said stacks such that contact lines between said central ends form the shape of a cross, and step (d) comprises continuing step (c) until said stacks are arranged into a circular shape as seen from a side view.

20. A method according to claim 17, wherein step (a) comprises providing four of said stacks, step (b) comprises positioning said stacks such that contact lines between said central ends form the shape of a cross, and step (d) comprises continuing step (c) until said stacks are arranged into a square shape as seen from the side view.

21. A method according to claim 17, wherein step (a) comprises providing four of said stacks, step (b) comprises positioning said stacks such that contact lines between said central ends form the shape of a cross displaced in a displacement plane and step (d) comprises continuing step (c) until said stacks are arranged into an elliptical shape as seen from a side view.

22. A method according to claim 17, wherein step (a) comprises providing four of said stacks, step (b) comprises positioning said stacks in the shape of a cross such that said central ends define a central rectangular cavity and step (d) comprises continuing step (c) until said stacks are arranged into a circular shape as seen from a side view.

23. A method according to claim 22, further comprising a step between steps (d) and (e) of pressing said circular-shaped stacks until said central rectangular cavity is eliminated.

24. A method according to claim 17, wherein at least one of said stacks of step (a) has at least a thickness which is different than the thickness of the other stacks.

25. A method according to claim 17, wherein at least one of said stacks of step (a) has at least a length which is different than the length of the other stacks.

26. A method according to claim 17, wherein step(a) comprises providing more than four of said stacks, step(b) comprises positioning said stacks such that contact lines between said central ends form acute angles with each other and step(d) comprises continuing step(c) until said stacks are arranged into a circular shape as seen from a side view.

27. A method according to claim 26, wherein step(a) comprises providing eight of said stacks.

* * * * *